US009508516B2

(12) United States Patent
Cantu Gonzalez

(10) Patent No.: US 9,508,516 B2
(45) Date of Patent: Nov. 29, 2016

(54) THERMAL TRIP DEVICE HAVING A CURRENT REDIRECTING LINKING ELEMENT, SWITCHING DEVICE, THERMAL MAGNETIC CIRCUIT BREAKER AND METHOD FOR PROTECTING AN ELECTRIC CIRCUIT

(71) Applicant: Siemens Aktiengesellschaft, Munich (DE)

(72) Inventor: Roberto Federico Cantu Gonzalez, San Nicolas De Los Garza (MX)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 7 days.

(21) Appl. No.: 14/522,706

(22) Filed: Oct. 24, 2014

(65) Prior Publication Data

US 2015/0206688 A1 Jul. 23, 2015

(30) Foreign Application Priority Data

Jan. 17, 2014 (EP) ..... 14151594

(51) Int. Cl.

| | |
|---|---|
| ***H01H 81/00*** | (2006.01) |
| ***H01H 83/00*** | (2006.01) |
| ***H01H 75/12*** | (2006.01) |
| ***H01H 77/00*** | (2006.01) |
| ***H01H 71/16*** | (2006.01) |
| *H01H 71/08* | (2006.01) |

(52) U.S. Cl.

CPC ..... *H01H 71/16* (2013.01); *H01H 71/164* (2013.01); *H01H 2071/084* (2013.01); *H01H 2071/168* (2013.01)

(58) Field of Classification Search

CPC ..... H01H 71/164; H01H 71/16; H01H 2071/168; H01H 2071/084

See application file for complete search history.

(56) References Cited

U.S. PATENT DOCUMENTS 4,163,881 A 8/1979 Coley
6,181,226 B1 * 1/2001 Leone et al. ..... 335/35

FOREIGN PATENT DOCUMENTS

| | | | |
|---|---|---|---|
| DE | 3410340 | A1 | 10/1985 |
| DE | 19500221 | A1 | 8/1995 |
| EP | 0691668 | A1 | 1/1996 |
| WO | WO 2013126061 | A1 | 8/2013 |

OTHER PUBLICATIONS

Extended European Search Report dated Jun. 6, 2014.

* cited by examiner

*Primary Examiner* — Bernard Rojas

(74) *Attorney, Agent, or Firm* — Harness, Dickey & Pierce, P.L.C.

(57) ABSTRACT

A thermal trip device, of a thermal magnet circuit breaker is disclosed for protecting an electrical circuit from damage by overload, a switching device and a thermal magnetic circuit breaker including at least the thermal trip device are disclosed. In at least one embodiment, the thermal trip device includes at least a bimetal element arranged with a first end at a current conductive element to conduct electrical current and arranged with a second end at a tripping slide adapted to interrupting a current flow. The at least a bimetal element is connectable with a linking element extending between the bimetal element and the current conductive element to redirect the electrical current at least partially. Furthermore, a method is disclosed for protecting an electric circuit from damage by overload by use of the thermal trip device of a thermal magnet circuit breaker.

13 Claims, 6 Drawing Sheets

THERMAL TRIP DEVICE HAVING A CURRENT REDIRECTING LINKING ELEMENT, SWITCHING DEVICE, THERMAL MAGNETIC CIRCUIT BREAKER AND METHOD FOR PROTECTING AN ELECTRIC CIRCUIT

PRIORITY STATEMENT

The present application hereby claims priority under 35 U.S.C. §119 to European patent application number EP 14151594.0 filed Jan. 17, 2014, the entire contents of which are hereby incorporated herein by reference.

FIELD

At least one embodiment of the present invention is generally directed to a thermal trip device of a thermal magnetic circuit breaker, wherein the thermal trip device has at least a bimetal element adapted to interrupting a current flow. At least one embodiment of the preset invention is also directed to a switching device having at least a bimetal element, a current conductive element, a tripping slide, a linking element and/or a kicker element. Furthermore, on the one hand, at least one embodiment of the present invention is directed to a thermal magnetic circuit breaker having a thermal trip device like mentioned above and on the other hand to a method for protecting an electric circuit from damage by overload by way of a thermal trip device of a thermal magnet circuit breaker.

BACKGROUND

Essentially, it is known that a thermal magnetic circuit breaker is a manually or automatically operating electrical switch designed to protect an electrical circuit from damage caused by overload or short circuit, for example. Its basic function is the detection of a fault condition and the interruption of current flow. Therefore, the thermal magnetic circuit breaker has for example at least one magnetic trip device in order to prevent the electrical circuit or an electrical device from damage by short circuit and a thermal trip device in order to prevent the electric circuit or an electrical device, like a load, from damage by overload. A short circuit is an abnormal connection between two nodes of the electric circuit intended to be at different voltages. This results in an excessive electric current, named an overcurrent limited only by the Thévenin equivalent resistance of the rest of the network and potentially causes circuit damage, overheating, fire or explosion. An overload is a less extreme condition but a longer-term over-current condition as a short circuit.

The thermal magnetic circuit breaker or breaker, respectively, has different settings or adjustments, respectively, as to where does the client wants the breaker to trip thermally. These settings go from 0.7 ln to 1 ln, wherein 0.7 ln means 70% of the nominal current rated on the breaker and 1 ln means 100% of the nominal current rated on the breaker. Therefore, in a 140 Amp breaker, 70% will be 700 Amp. Basing on a lower thermal adjustment, less electrical current goes through a conductive element like a conductor and results on a lower temperature on a bimetal element of the thermal trip device. Thus, the temperature profile of the thermal trip device of the thermal magnetic circuit breaker or thermal magnetic trip unit (TMTU) presents low temperature behaviour on the lower thermal adjustment side, which is for example 70% ln and therefore 70% of the nominal current, as mentioned above. Since the movement of the bimetal element is a result of the temperature, such a low temperature is not enough in order to reach deflection and force of the bimetal element of the thermal trip device, which are necessary to unlatch the breaker mechanism. Therefore, a lower electrical current inducts a less temperature and as a consequence a less deflection and/or force of the bimetal element, during a high electrical current inducts a higher temperature and as a consequence a higher deflection and/or force of the bimetal element.

SUMMARY

At least one embodiment of the present invention is directed to a thermal magnetic circuit breaker and especially a thermal trip device of a thermal magnetic circuit breaker and more especially a switching device, which allow in an easy and cost-effective manner a triggering of the thermal magnetic circuit breaker and especially an element of the thermal magnetic circuit breaker in order to interrupt a current flow of the electrical circuit in order to protect the circuit and the loads of latter from damage.

At least one embodiment of the present invention is directed to a thermal trip device, a switching device, a thermal magnetic circuit breaker and/or a method for protection an electric circuit from damage by overload by way of a thermal trip device of a thermal magnet circuit breaker. Further features and details of the invention are subject of the sub claims and/or emerge from the description and the figures. Features and details discussed with respect to the thermal trip device can also be applied to the switching device, the thermal magnetic circuit breaker and/or the method for protecting an electric circuit from damage and vice versa.

The thermal trip device of a thermal magnet circuit breaker for protecting an electrical circuit from damage by overload has at least a bimetal element in order to be arranged with its first end at a current conductive element for conducting electrical current and in order to be arranged with its second end at a tripping slide adapted to interrupting a current flow, wherein the bimetal element is able to be connected with a linking element extending between the bimetal element and the current conductive element in order to redirect the electrical current at least partially.

BRIEF DESCRIPTION OF THE DRAWINGS

Embodiments of a thermal trip device and of a magnetic trip device of a thermal magnetic circuit breaker and a switching device are explained in more detail with reference to the accompanying drawings. The drawings show schematically in.

Figure 1:
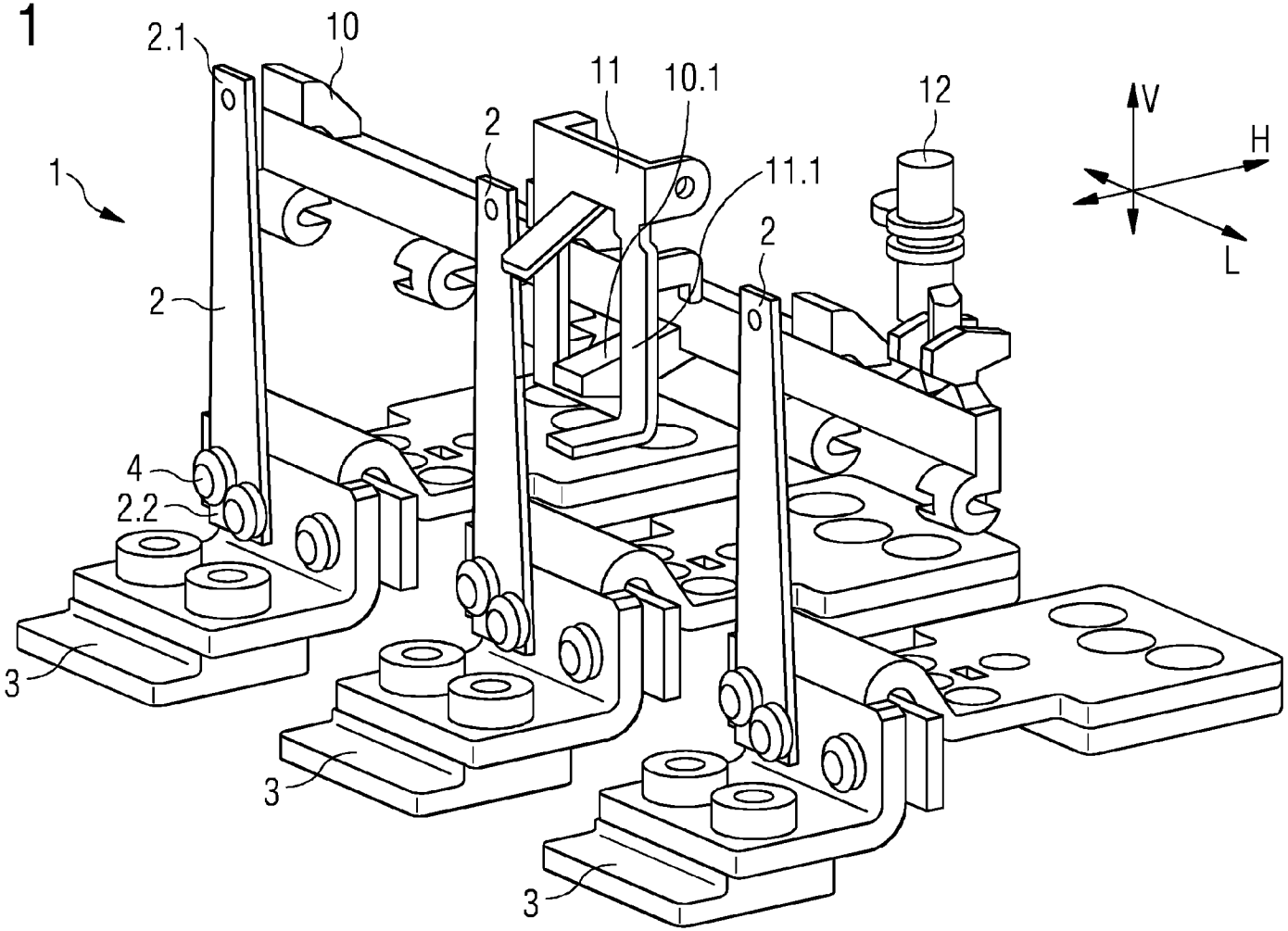
FIG. 1: a perspective view of a first embodiment of a thermal trip device arranged at a current conductive element for example.

Elements having the same function and mode of action are provided in FIGS. 1 to 6 with the same reference signs.

DETAILED DESCRIPTION OF THE EXAMPLE EMBODIMENTS

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Before discussing example embodiments in more detail, it is noted that some example embodiments are described as processes or methods depicted as flowcharts. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Methods discussed below, some of which are illustrated by the flow charts, may be implemented by hardware, software, firmware, middleware, microcode, hardware description languages, or any combination thereof. When implemented in software, firmware, middleware or microcode, the program code or code segments to perform the necessary tasks will be stored in a machine or computer readable medium such as a storage medium or non-transitory computer readable medium. A processor(s) will perform the necessary tasks.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Portions of the example embodiments and corresponding detailed description may be presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

In the following description, illustrative embodiments may be described with reference to acts and symbolic representations of operations (e.g., in the form of flowcharts) that may be implemented as program modules or functional processes include routines, programs, objects, components, data structures, etc., that perform particular tasks or implement particular abstract data types and may be implemented using existing hardware at existing network elements. Such existing hardware may include one or more Central Processing Units (CPUs), digital signal processors (DSPs), application-specific-integrated-circuits, field programmable gate arrays (FPGAs) computers or the like.

Note also that the software implemented aspects of the example embodiments may be typically encoded on some form of program storage medium or implemented over some type of transmission medium. The program storage medium (e.g., non-transitory storage medium) may be magnetic (e.g., a floppy disk or a hard drive) or optical (e.g., a compact disk read only memory, or "CD ROM"), and may be read only or random access. Similarly, the transmission medium may be twisted wire pairs, coaxial cable, optical fiber, or some other suitable transmission medium known to the art. The example embodiments not limited by these aspects of any given implementation.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device/hardware, that manipulates and transforms data represented as physical, electronic quantities within the computer system's registers and memories into other data similarly represented as physical quantities within the computer system memories or registers or other such information storage, transmission or display devices.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The thermal trip device of a thermal magnet circuit breaker for protecting an electrical circuit from damage by overload has at least a bimetal element in order to be arranged with its first end at a current conductive element for conducting electrical current and in order to be arranged with its second end at a tripping slide adapted to interrupting a current flow, wherein the bimetal element is able to be connected with a linking element extending between the bimetal element and the current conductive element in order to redirect the electrical current at least partially.

Advantageously, the thermal trip device is a part of the thermal magnetic circuit breaker mentioned above and has at least a bimetal element, which is composed of at least two separate metals joined together. The bimetal element consist of two layers of different metals, for example, wherein bimetal elements having three or four separate metals or layers, respectively, are referred to as trimetal or tetrametal. Therefore, the bimetal element of the present inventions is also able to have three, four or more than four separate metals or layer, respectively.

The electrical current flowing through the conductive element emits heat, by which the bimetal element or trimetal element or tetrametal element, and so on, is heated, wherein due to this heat, a movement and especially a deflection of the bimetal element is triggered. That means, basing on the nature of the bimetal element, it converts the heat or temperature, respectively, into mechanical displacement generating certain amount of force. Thus, the amount of heat restricts the amount of force that will generate. Increasing the temperature generally of the current path and especially in the area of the conductive element of the thermal trip device results for example in overheating of lugs arranged at least nearly the conductive element above especial requirement specifications and therefore above for example 50° C. Thus, an increasing of the temperature in order to optimize the movement of the bimetal element in order to interrupt the electrical current flow of the current circuit for protecting the circuit from overload and so on, leads to damage loads or comparable products. In the context of the present invention the electrical circuits includes also at least one load like an electrical device.

The bimetal element has a first end, also named lower end and a second end, also named upper end, wherein the second end contacts at least partially a part of the current conductive element conducting electrical current along at least a part of the current path. Heat or thermal radiation, respectively, emitted by the electrical current flowing through the current conductive element moves from the current conductive element above the first end of the bimetal element to the bimetal element in such a way that the bimetal element is heated indirectly. The heat causes the bimetal element to deflect, wherein the bimetal element applies a force into a tripping slide. That means that the area of the first end of the bimetal element moves in direction to the tripping slide in order to contact at least a contact zone of the tripping slide. If the movement or deflection, respectively, is not stopped the first end of the bimetal element press against the tripping slide. Basing on the movement of the bimetal element, the tripping slide rotates clockwise around a longitudinal axis and releases a kicker for interrupting the current flow.

According to at least one embodiment of the present invention, the thermal trip device and especially the bimetal element of the thermal trip device is able to contact and is advantageously arranged at a linking element. It is also conceivable that the linking element is a part of the thermal trip device. By way of the linking element, it is possible to heat the bimetal element directly and indirectly. Therefore, electrical current is redirected at least partly along the linking element and especially at least along a part of the bimetal element connected with the conductive element and the linking element, advantageously.

Advantageously, the linking element is arranged with its one end between the first end and the second end of the bimetal element and in particular in a middle area of the bimetal element with respect to its longitudinal axis. Therefore, electrical current or current, respectively, flows from the current conductive element shaped as current line, for example, via at least a part of the bimetal element and especially a lower part of the bimetal element back to the current conductive element. It is also conceivable that the one end of the linking element is arranged at the upper end or essentially near the upper end of the bimetal element or at the lower end or essentially near the lower end of the bimetal element and therefore in an upper or lower area of the bimetal element.

Advantageously, the linking element has a flexible material having at least partially a linear elastic behaviour. For example, the Hooke's law describes the elastic behaviour of components where deformation is proportional to the load acting upon them. By way of the flexible or elastic material, respectively, a movement of the bimetal element is possible without damage the linking element arranged at and especially fixed with the bimetal element at least partially.

Therefore, it is conceivable that the linking element has a well-conductive material like a copper material and is especially a copper braid. Copper is a ductile metal with very high thermal and electrical conductivity, wherein especially pure copper is soft and malleable. Therefore, copper is useable as a conductor of heat and electricity. It is also conceivable that other elastic and thermal conductive and electrical conductive materials are used individually or in combination.

With respect to at least one embodiment of the present invention, it is conceivable that the linking element is adjustable arranged at the bimetal element and/or at the current conductive element. Advantageously, basing on this adjustment, the length of the current path leading the electrical current along the bimetal element is variable. Thus, also the temperature or heat heating the bimetal element is variable. The adjustable arrangement is realisable for example by way of fixing elements like clamps or such comparable elements. It is also conceivable that the one end and/or the second end of the fixing element are welded on the bimetal element and/or the current conductive element.

Advantageously, the linking element has at least a length of circa 3 cm and/or a diameter of circa 4 mm.

By way of the linking element, a technical contradiction is solved, wherein temperature on the bimetal element is increased without going over permissible temperature on the lugs due to selective heating, for example. Therefore, a direct and indirect heating of the bimetal element that allows thermal adjustment on the low side is combined, advantageously.

Furthermore, a switching device having at least a bimetal element in order to be arranged with its first end at a current conductive element and in order to be arranged with its second end at a tripping slide is disclosed.

It is advantageously conceivable that the switching element also has the current conductive element for conducting electrical current, the tripping slide adapted to interact with a kicker element, a linking element extending between the bimetal element and the current conductive element in order to redirect the electrical current at least partially and/or the kicker element in order to hitch a mechanism trip bar unlatching a breaker mechanism to interrupt the current flow. Advantageously, the switching device combines different devices and/or elements like the thermal trip device or the bimetal element of the thermal trip device with a kicker, for example, in order to generate an activity chain by way of different devices and/or elements working together in order to interrupt a current flow during a trip event like an overload and so on I occurred. Current flowing through the conductive element flows via at least a part of the bimetal element and via the linking element back to the current conductive element arranged at the bimetal element and also at the linking element and formed like a current line, for example. When the bimetal element starts heating up by way of the current flowing though the latter, especially the upper end of the bimetal element moves or deflects, respectively, towards the tripping slide and pushes latter in such a way that the tripping slide rotates around its axis in clockwise direction. Due to the rotation of the tripping slide, the kicker, which is loaded with a spring element like a torsion spring, for example, is released. Therefore, the kicker held in position due to a latch feature of the tripping slide, the kicker moves forward with the help of the spring element in direction to a mechanism trip bar. The mechanism trip bar unlatches the thermal magnet circuit breaker mechanism and opens contact blades in order to interrupt current flow.

The switching device mentioned above also has all advantages mentioned above concerning the thermal trip device.

Furthermore, a thermal magnetic circuit breaker for protecting an electrical circuit from damage caused by overload or short circuit is claimed, wherein the thermal magnetic circuit breaker has at least a thermal trip device according to one of the preceding claims and therefore a thermal trip device like mentioned above.

Advantageously, the thermal magnetic circuit breaker, also named thermal magnetic trip unit (TMTU), has a translational magnetic system and especially a translational magnetic trip device with a common adjustment system like an adjustment bar for an instantaneous setting.

It is conceivable that the magnetic trip device of the thermal magnetic circuit breaker has an armature element reacting to a magnetic field resulting from current flowing through a solenoid element. Advantageously, the magnetic trip device has at least an armature element movable arranged with respect to a yoke or especially to a current conductive element conducting electrical energy or current, respectively. The armature element or armature, respectively, is a magnetic element and especially a pole piece having at least partially an iron material and reacting to a magnetic field created by the yoke during a trip moment. In order to realize a guided movement of the armature element towards the yoke at least during a trip event like a short circuit, the armature element is arranged on an armature locator. The armature locator is moveable arranged on a pin extending from an adjustment bar towards the yoke, for example. The armature locator or the adjustment bar can be connected with a tripping slide, which is able to interrupt a current flow of the current circuit, when the tripping slide is moved due to a movement of the armature locator or the adjustment bar in conjunction with the armature element towards the yoke because of a magnetic force.

The thermal magnetic circuit breaker mentioned above also has all advantages mentioned above concerning the thermal trip device and/or the switching device.

Furthermore, a method for protecting an electric circuit from damage by overload by way of a thermal trip device of a thermal magnet circuit breaker is claimed. According to this method, an electric current is conducted at least partially from a current conductive element via at least a part of a bimetal element arranged with its lower end on the current conductive element, along a linking element arranged essentially between the current conductive element and the bimetal element, back to the current conductive element in order to heat or temperature the bimetal element to obtain a mechanical displacement of at least one area of the bimetal element.

Like mentioned above a first or upper end, respectively, of the bimetal element contacts a part of a tripping slide at least indirectly, when the bimetal element heats up and a mechanical displacement of at least the first end of the bimetal element is obtained. Afterwards, the tripping slide pushed by the upper end of the bimetal element releases a kicker. Due to a movement of the released kicker, a mechanism trip bar is hit in order to unlatch a breaker mechanism to interrupting a current flow.

Advantageously, the thermal trip device is made according to one of the preceding embodiments and therefore like mentioned above.

Advantageously, by at least one embodiment of the present invention, a combination of directly and indirectly heated bimetal element basic concept is used, wherein especially a heat spot or selective heating method was created to be applied on a specific area.

The method mentioned above also has all advantages mentioned above concerning the thermal trip device and/or the switching device and/or the thermal magnetic circuit breaker.

In FIG. 1 a perspective view of a first embodiment of a thermal trip device 1 arranged at a current conductive element 3 is shown. The current conductive element 3 extends in horizontally direction H at least partially. A bimetal element 2 contacts the current conductive element 3, wherein a second end 2.2 or lower end 2.2, respectively, of the bimetal element 2 is arranged and advantageously fixed at the current conductive element 3 with fixing elements 4, for example. Non-detachably or detachably arranged fixing elements 4 are for example screws, rivets or comparable elements. The first end 2.1 or upper end 2.1, respectively, of the bimetal element 2 is able to contact a tripping slide 10 tripping and especially a contacting area of the tripping slide 10, when a trip event is occurred. That means, if an overload is occurred the bimetal element 2 is heated up by way of the current flowing through the current conductive element 3 and is moved or deflected especially by way of its first end 2.1 in direction to the tripping slide 10. The bimetal element 2 extend in a vertically direction V at least partially.

The tripping slide 10 arranged at a kicker 11 or a kicker element 11, respectively, has a release element 10.1 in form of a protrusion extending from the tripping slide 10 in direction to the kicker 11. The release element 10.1 contacts a yoke element 11.1 of the kicker 11 in order to hold the kicker 11 in a first position or an initial position, respectively, in which the current path is not interrupt. Therefore, the release element 10.1 has a hook intervening at the yoke element 11.1.

With a knob 12, the position of the tripping slide 10 is adjustable in order to adjust a reaction time of the tripping slide 10 for releasing the kicker 11, for example.

Figure 2:
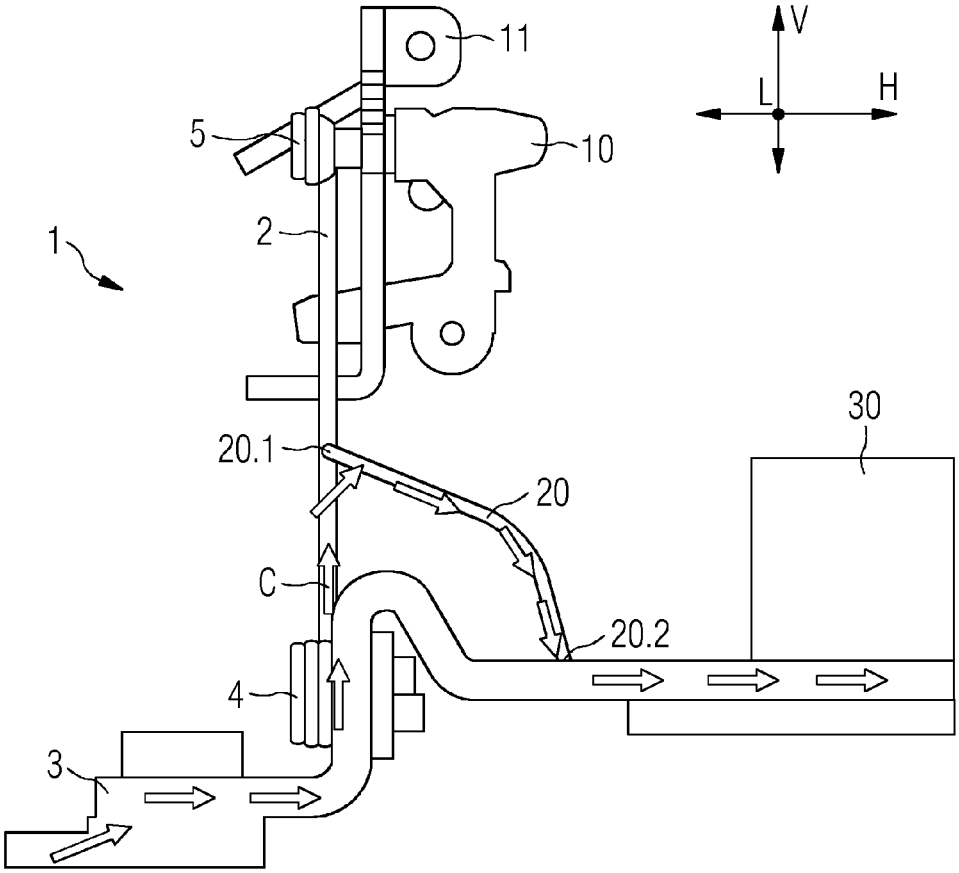
FIG. 2: a side view of an embodiment of a thermal trip device arranged at a current conductive element and having a linking element.

FIG. 2 shows a side view of a further embodiment of a thermal trip device 1 arranged at a current conductive element 3 and having a linking element 20. The arrangement of the bimetal element 2, the current conductive element 3, the tripping slide 10 and the kicker 11 essentially corresponds to the arrangement of these parts or elements, respectively, mentioned above with respect to FIG. 1. Therefore, the explanations mentioned above about these elements serves as basis for the following explanations.

The linking element 20 extends from the current conductive element 3 to the bimetal element 2 in order to realize a current path to lead or redirect, respectively, the electrical current. The linking element 20 has one end 20.1 or an upper end 20.1, respectively, which contacts the bimetal element 2 between its first end 2.1 and its second end 2.2. The other end 20.2 or lower end 20.2, respectively, of the linking element 20 contacts the current conductive element 3. Therefore, the linking element 20 is an intermediate piece or connecting piece, respectively, between the bimetal element 2 and the current conductive element 3. Advantageously, the linking element 20 is a copper braid having at least partially a flexible material in order to allow a movement of the bimetal element 2 during a trip event is occurred in direction to the tripping slide 10 without damaging the linking element 20 arranged at the bimetal element 2. The material of the linking element 20 is electrically conductive at least partially. Thus, electrical current flowing through the current conductive element 3 is redirected from conductive element 3 via the bimetal element 2 and the linking element 20 back to the current conductive element 3. This new current path is shown with reference sign C. Advantageously, electrical current flowing through the bimetal element 2 results in increasing temperature of the bimetal element and in deflection and force of the latter, without affecting the temperature restrictions on lugs 30. It is conceivable that the linking element 20 is welded with its one side to the centre of the bimetal element 2, wherein the centre of the bimetal element 2 extends between the first end 2.1 and the second end 2.1 of the bimetal element. Furthermore, it is conceivable that the other end 20.2 of the linking element 20 is welded to the current conductive element 3, which is a current conductive line or a load terminal, for example.

Near the bimetal element 2 at least one lug 30 is arranged at the current conductive element 3, which is formed like a current conductive line, for example.

The first end 2.1 of the bimetal element 2 is arranged at a contacting element 5 contacting the tripping slide 10. Thus, when the bimetal element 2 is deflected basing on the heat of the electrical current flowing along the new electrical current path C, the first end 2.1 of the bimetal element 2 moves in direction to the tripping slide 10. Therefore, the contacting element 5 pushes the tripping slide 10 in direction away from the bimetal element 2. Basing on this movement, the tripping slide 10 rotates about its longitudinal axis L1 (for example shown in FIG. 3) extending essentially in longitudinal direction L. Basing on this rotation, the release element 10.1 of the tripping slide 10 releases the kicker 11 in such a way that the kicker 11 also rotates about its longitudinal axis L2 (for example shown in FIG. 3) extending in longitudinal direction L in order to interrupt a current flow of electrical current.

Figure 3:
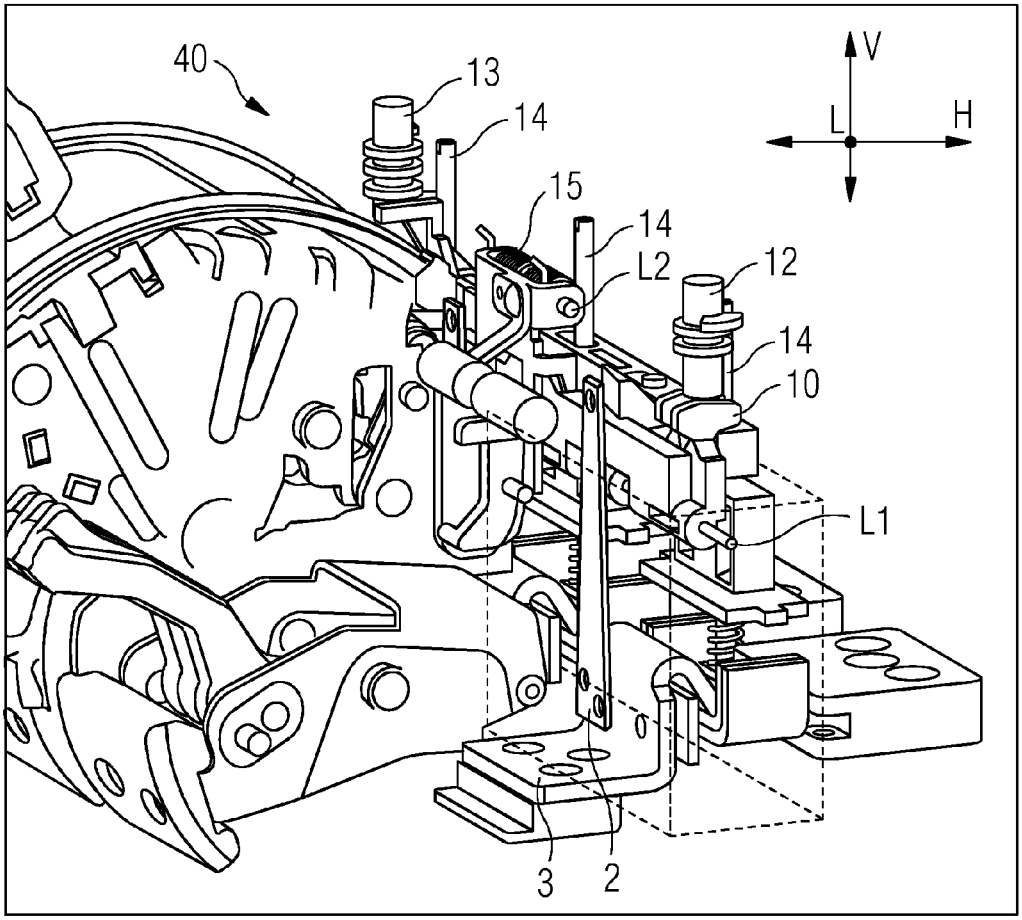
FIG. 3: a perspective view of an embodiment of a switching device.

In FIG. 3, a perspective view of an embodiment of a switching device 40 is shown. Advantageously, the switching device 40 is a part of the thermal magnetic circuit breaker having at least a thermal trip device and/or a magnetic trip device. Advantageously, the switching device 40 has at least a thermal trip device shown in FIG. 1 or 2, and therefore a bimetal element 2, a current conductive element 3, a tripping slide 10, a kicker 11 and/or a mechanism trip bar 16, especially shown in FIG. 5.

Figure 4:
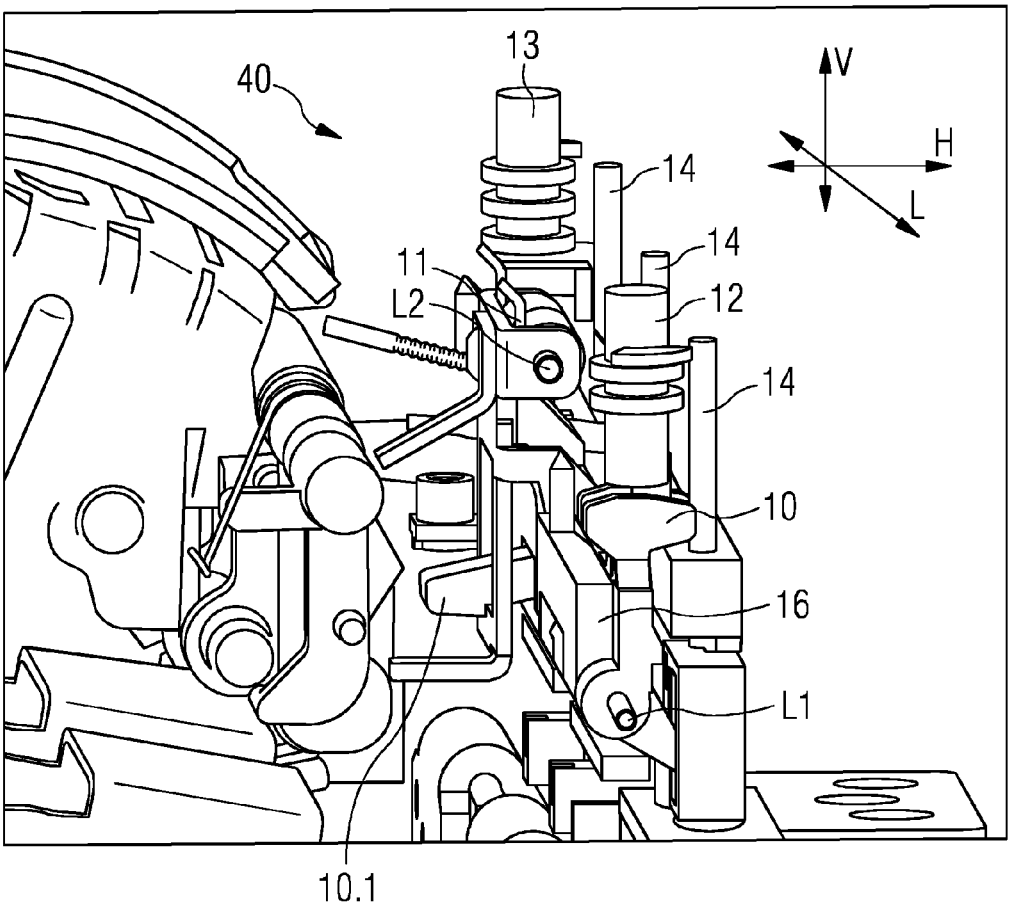
FIG. 4: a side view of different parts of a switching device.

Like shown in FIGS. 3 and 4, wherein FIG. 4 shows a side view of different parts of a switching device, the kicker 11 has a spring element 15 like a torsion spring, for example, in order to move the kicker 11 around its longitude axis L2, when the kicker 11 is released. Therefore, the kicker 11 rotates in clockwise direction. Furthermore, a knob 12 and a knob 13 are arranged at the switching device 40. By way of knob 12, an adjustment of the tripping slide 10 is possible, for example. Therefore, by way of knob 13 an adjustment of the magnetic trip device is possible, for example. The magnetic tip device, especially shown in FIG. 6, has inter alia a pin 14 extending in vertical direction V in order to lead an armature and especially an armature locator, also shown in FIG. 6.

Figure 5:
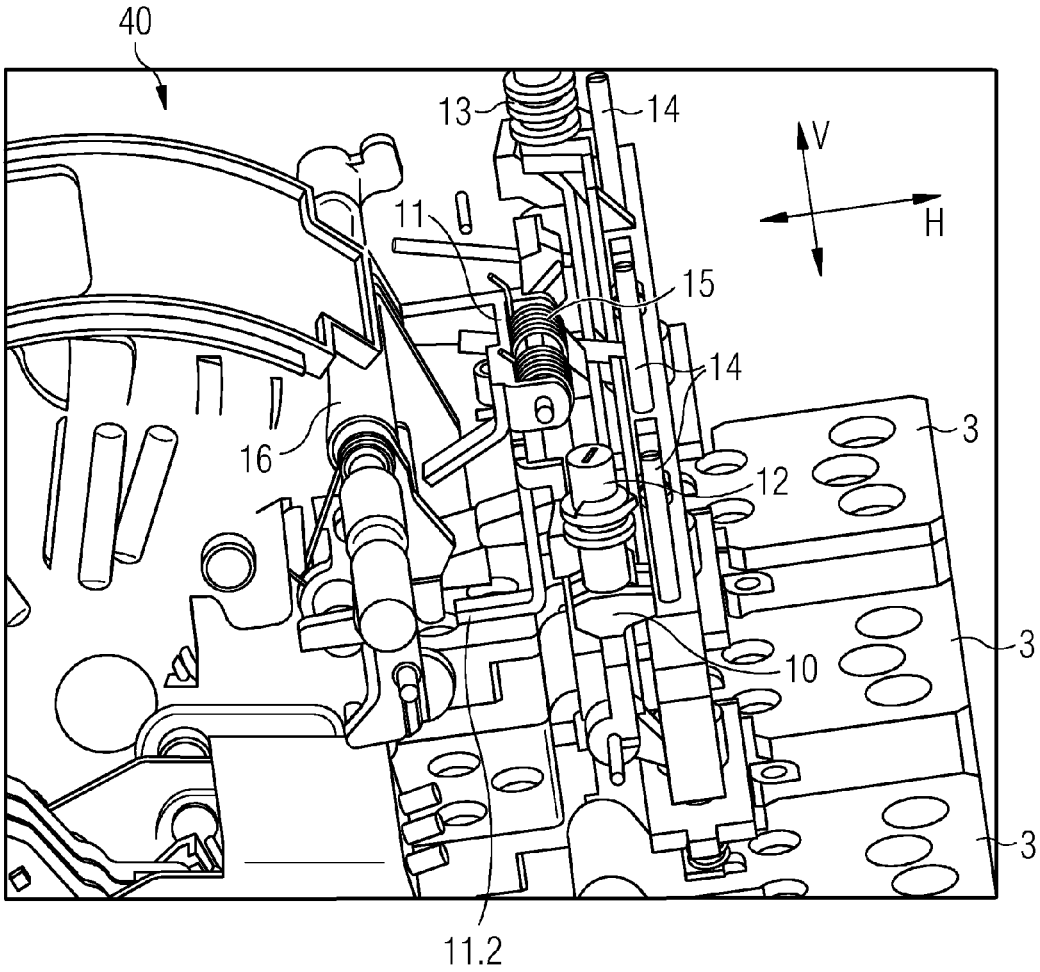
FIG. 5: a perspective view of the switching device shown in FIG. 3, and FIG. 6: a perspective view of an embodiment of a magnetic trip device of a thermal magnetic circuit breaker arranged on a current conductive element.

Like shown in FIG. 5, in which a perspective view of the switching device shown in FIG. 3 is pictured, for example, the kicker 11 has a protrusion 11.1 and especially a hitting protrusion 11.2, which is able to unlatch a mechanism trip bar 16 during a trip event is occurred and therefore during the tripping slide 10 rotates around its longitudinal axis L1 in order to release the kicker 11, which also rotates around its longitudinal axis L2.

Figure 6:
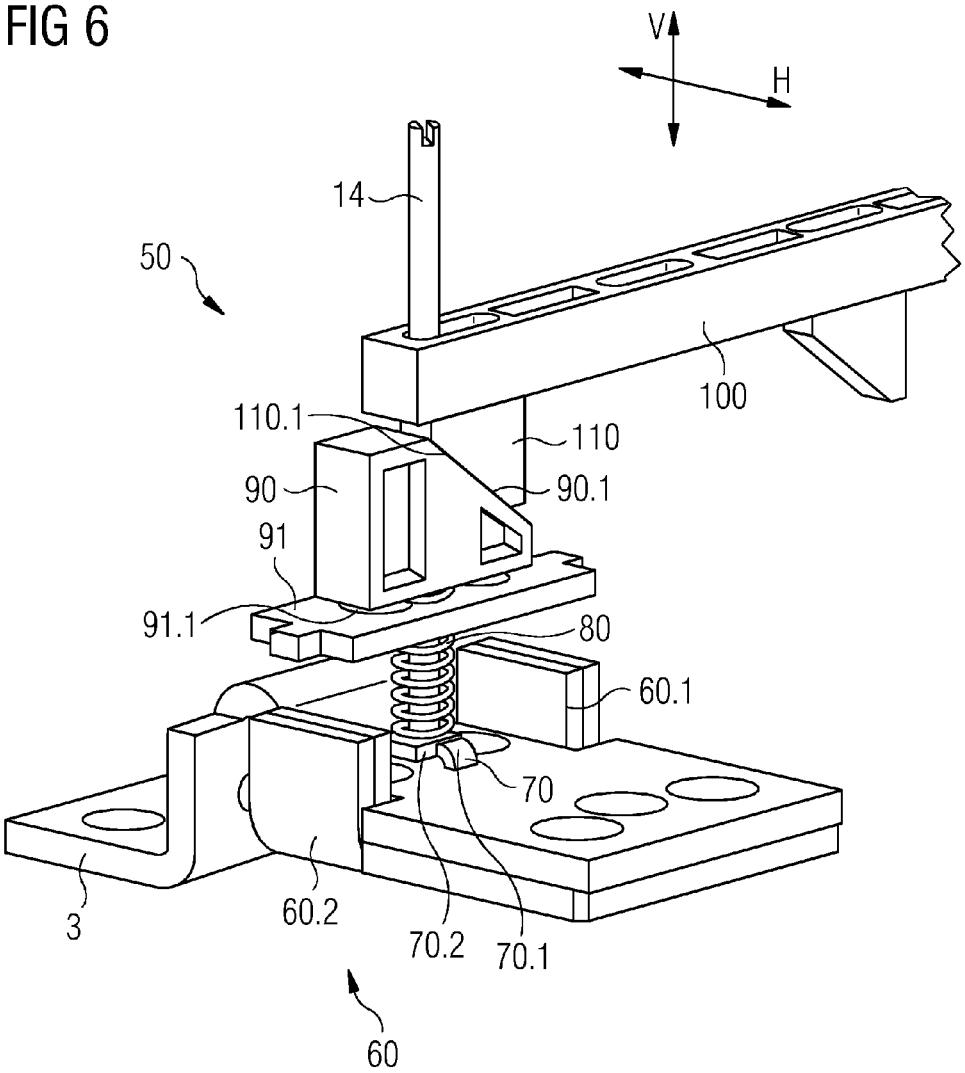

In FIG. 6 a perspective view of an embodiment of a magnetic trip device 50 arranged at a current conductive element 3 is shown. The current conductive element 3 contacts a yoke 60 and especially its upper layer 60.1 or first layer 60.1, respectively. Therefore, the current conductive element 3 extends through the yoke 60 and essentially between the legs of the yoke 60 along the yoke 60. The current conductive element 3 for conducting an electrical current along an electrical path has a recess (hidden in the present view), which is formed like a hole or a bore for example. A protrusion area 70.1 like a nose or a hook of an adjustment element 70 extends into this recess. The adjustment element 70, which is preferably designed like a calibration plate has a L-shape with respect to its cross-section, wherein one leg of the L is the protrusion area 70.1 and the other leg of the L is a contacting area 70.2 extending essentially at least partially parallel to a surface of the current conductive element 3 in the area of the yoke 60. The contacting area 70.2 is used to clamp a spring element 80 between the adjustment element 70 and an armature locator 90. It is conceivable that the lower end of the spring element 80 contacting the adjustment element 70 is fixed with the adjustment element 70, wherein for example an end of the winding of the spring element 80 extends into the contacting area 70.2 and especially into a recess or such a thing of the contacting area 70.2 of the adjustment element 70. Advantageously, the spring element 80 is removable arranged at or fixed with the adjustment element 70. The spring element 80 extending between the adjustment element 70 and the armature locator 90 extends through the armature element 91 and especially through a bore 91.1 or a through-hole 91.1 of the armature element 91. The spring element 80 surrounds the pin 14 and especially the perimeter of the pin 14. Advantageously, the upper end or an upper area, respectively, of the spring element 80 is arranged inside a not shown recess or counterbore, respectively, of the armature locator 90. The spring element 80 has a defined spring load and spaces the armature 91 from the yoke 60, when no trip event like a short circuit is occurred.

The pin 14 extends also through an adjustment bar 100, wherein the lower part of the pin 14 has a not shown threaded portion and especially an external thread, which is moveably engaged with a not shown internal thread of the adjustment element 70 and/or with a not shown internal thread of the current conductive element 3.

It is conceivable that the adjustment bar 100 has a not shown transfer element extending at least partially in a horizontal direction H away from the adjustment bar 100 in order to contact a tripping slide 10 shown in FIG. 1, for example. Basing on the movement of the armature element 91 in direction to the yoke 60 during a trip event, the armature locator 90 and the adjustment bar 100 arranged to the armature locator 90 are moved in vertical direction V along the pin 14. Therefore, the transfer element is also moved in direction to the yoke 60 and especially in vertical direction V. Basing on this movement, the tripping slide 10 is pushed to its final position, where the energy storage (not shown in FIG. 6) is released.

When the adjustment bar 100 is moved in a horizontal direction H, for example in direction to the armature locator 90 (leftwards), the armature locator 90 is moved downwards in direction to the yoke 60 and therefore in vertical direction V. Basing on this movement, the distance between the armature element 91 and the yoke 60 is reduced. The transformation of the horizontal movement of the adjustment bar 100 into a vertical movement of the armature locator 90 is done by way of both, the inclined area 110.1 or inclined surface 110.1, respectively, of the protrusion 110 of the adjustment bar 100 and the inclined area 90.1 or surface 90.1, respectively, of the armature locator 90. Both, inclined area 110.1 and inclined area 90.1 contact each other and are movable arranged to each other in such a way that the inclined areas 110.1 and 90.1 slide against each other. Therefore, during a horizontal movement of the adjustment bar 100 in direction away from the armature locator 90 (rightwards), the armature locator 90 is moved in vertical direction V away from the yoke 60 (upwards) due to the spring load of the spring element 80. That means that the spring element 80 pushes back the armature locator 90. The adjustment bar 100 is only shown in sections in FIG. 6 and has preferably more than one protrusion 110 and especially two or three protrusions 110 in order to contact two or three single magnetic trip devices 50, for example as a three pole arrangement.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Even further, any of the aforementioned methods may be embodied in the form of a program. The program may be stored on a tangible computer readable medium and is adapted to perform any one of the aforementioned methods when run on a computer device (a device including a processor). Thus, the tangible storage medium or tangible computer readable medium, is adapted to store information and is adapted to interact with a data processing facility or computer device to execute the program of any of the above mentioned embodiments and/or to perform the method of any of the above mentioned embodiments.

The tangible computer readable medium or tangible storage medium may be a built-in medium installed inside a computer device main body or a removable tangible medium arranged so that it can be separated from the computer device main body. Examples of the built-in tangible medium include, but are not limited to, rewriteable non-volatile memories, such as ROMs and flash memories, and hard disks. Examples of the removable tangible medium include, but are not limited to, optical storage media such as CD-ROMs and DVDs; magneto-optical storage media, such as MOs; magnetism storage media, including but not limited to floppy disks (trademark), cassette tapes, and removable hard disks; media with a built-in rewriteable non-volatile memory, including but not limited to memory cards; and media with a built-in ROM, including but not limited to ROM cassettes; etc. Furthermore, various information regarding stored images, for example, property information, may be stored in any other form, or it may be provided in other ways.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

REFERENCE SIGNS

1 thermal trip device
2 bimetal element
2.1 first end/upper end of the bimetal element
2.2 second end/lower end of the bimetal element
3 current conductive element
4 fixing element
5 contacting element
10 tripping slide
10.1 release element
11 kicker
11.1 yoke element
11.2 hitting protrusion
12 knob
13 knob
14 pin
15 spring element
16 mechanism trip bar
20 linking element
20.1 one end/upper end of the linking element
20.2 other end/lower end of the linking element
30 lug
40 switching device
50 magnetic trip device
60 yoke
60.1 first layer of the yoke
60.2 second layer of the yoke
70 adjustment element
70.1 protrusion area
70.2 contacting area
80 spring element
90 armature locator
90.1 inclined area of the armature locator
91 armature element
91.1 bore/hole
100 adjustment bar
110 protrusion
C new/alternative electrical current path
H horizontal direction
L longitudinal direction
L1 longitudinal axis if the tripping slide
L2 longitudinal axis of the kicker
V vertical direction

What is claimed is:

1. Thermal trip device of a thermal magnet circuit breaker for protecting an electrical circuit from damage by overload, comprising:

at least one bimetal element, arranged with its first end at a current conductive element to conduct electrical current and arranged with its second end at a tripping slide, adapted to interrupt a current flow, wherein the at least one bimetal element connectable with a linking element extending between the at least one bimetal element and the current conductive element to at least partially redirect the electrical current, wherein the linking element is arranged with one end affixed between the first end and the second end of the at least one bimetal element and another end affixed to the current conductive element.

2. Thermal trip device of claim 1, wherein the linking element includes a flexible material having at least partially a linear elastic behavior.

3. Thermal trip device of claim 1, wherein the linking element includes a well-conductive material like a copper material.

4. Thermal trip device of claim 1, wherein the linking element is adjustably arranged at at least one of the at least one bimetal element and the current conductive element.

5. A switching device, comprising:

at least one bimetal element, arranged with a first end at a current conductive element and arranged with a second end at a tripping slide, the current conductive element being configured to conduct electrical current, the tripping slide adapted to interact with a kicker element, and a linking element extending between the at least one bimetal element and the current conductive element to at least partially redirect at least one of the electrical current and the kicker element in order to hitch a mechanism trip bar, to unlatch a breaker mechanism, to interrupt the current flow, wherein the linking element is arranged with one end affixed between the first end and the second end of the at least one bimetal element and another end affixed to the current conductive element.

6. A thermal magnetic circuit breaker for protecting an electrical circuit from damage caused by overload or short circuit, comprising:

at least the thermal trip device of claim 1.

7. The thermal magnetic circuit breaker of claim 6, further comprising:

a magnetic trip device, including at least an armature element to react to a magnetic field resulting from current flowing through a solenoid element.

8. A method for protecting an electric circuit from damage by overload via a thermal trip device of a thermal magnet circuit breaker, the method comprising:

conducting an electric current at least partially from a current conductive element, via at least a part of a bimetal element arranged with a lower end on the current conductive element, along a linking element arranged between the current conductive element and the bimetal element, and back to the current conductive element to heat the bimetal element to obtain a mechanical displacement of at least one area of the bimetal element, wherein the linking element is arranged with one end affixed between the first end and the second end of the at least one bimetal element and another end affixed to the current conductive element.

9. The method of claim 8, wherein the thermal trip device includes at least one bimetal element, arranged with its first end at a current conductive element to conduct electrical current and arranged with its second end at a tripping slide, adapted to interrupt a current flow, wherein the at least one bimetal element connectable with a linking element extending between the at least one bimetal element and the current conductive element to at least partially redirect the electrical current.

10. Thermal trip device of claim 1, wherein the linking element is arranged with one end between the first end and the second end of the at least one bimetal element, in a middle area of the at least one bimetal element with respect to its longitudinal axis.

11. Thermal trip device of claim 3, wherein the linking element includes a copper braid.

12. Thermal trip device of claim 1, wherein the linking element is directly attached to a surface of the at least one bimetal element and a surface of the current conductive element.

13. The thermal magnetic circuit breaker of claim 6, wherein the linking element is directly attached to a surface of the at least one bimetal element and a surface of the current conductive element.

* * * * *